US009919907B2

(12) United States Patent
Hagl

(10) Patent No.: US 9,919,907 B2
(45) Date of Patent: Mar. 20, 2018

(54) METHOD FOR CONTROLLING A COMBINED ROTARY/PUSH MOVEMENT

(71) Applicant: JUNGHEINRICH AKTIENGESELLSCHAFT, Hamburg (DE)

(72) Inventor: Bernhard Hagl, Haag a.d. Amper (DE)

(73) Assignee: JUNGHEINRICH AKTIENGESELLSCHAFT, Hamburg (DE)

( * ) Notice: Subject to any disclaimer, the term of this patent is extended or adjusted under 35 U.S.C. 154(b) by 241 days.

(21) Appl. No.: 14/830,837

(22) Filed: Aug. 20, 2015

(65) Prior Publication Data

US 2016/0052760 A1 Feb. 25, 2016

(30) Foreign Application Priority Data

Aug. 22, 2014 (DE) ..... 10 2014 216 736

(51) Int. Cl.
*B66F 9/07* (2006.01)
*B66F 9/22* (2006.01)
(Continued)

(52) U.S. Cl.
CPC ..... *B66F 9/22* (2013.01); *B66F 9/07* (2013.01); *B66F 9/147* (2013.01); *F15B 11/003* (2013.01);
(Continued)

(58) Field of Classification Search
CPC .... B66F 9/147; B66F 9/07; B66F 9/22; B66F 9/125; B66F 9/0755; B65G 1/0421; F15B 11/161; F15B 11/003
See application file for complete search history.

(56) References Cited

U.S. PATENT DOCUMENTS 5,143,180 A 9/1992 Harper
6,220,027 B1 * 4/2001 Heusser ..... B66F 9/147 60/422
(Continued)

FOREIGN PATENT DOCUMENTS

DE 2050523 A1 4/1972
DE 3017456 A1 11/1981
(Continued)

OTHER PUBLICATIONS

Search Report issued in European Patent Application No. 15181758.2, 6 pages (dated Jan. 27, 2016).
(Continued)

*Primary Examiner* — F. Daniel Lopez
*Assistant Examiner* — Abiy Teka
(74) *Attorney, Agent, or Firm* — Rothwell, Figg, Ernst & Manbeck, P.C.

(57) ABSTRACT

The invention relates to a method and device for controlling a combined rotary/push movement of a load-receiving means of an industrial truck, in particular a three-way stacker, both the rotary movement and the push movement being brought about by means of respective hydraulic elements (32, 34), which are supplied with hydraulic fluid by a single hydraulic pump (22) which is driven by an associated pump motor (24), and a performance characteristic of the hydraulic pump (22) being controlled according to a predetermined progression over time during the rotary/push movement; the industrial truck comprising a valve assembly (30) which is designed to be operated such that, below a threshold value for the hydraulic pressure provided by the hydraulic pump (22), only the rotary movement of the load-receiving means is brought about, while, above the threshold value, both the rotary movement and the push movement are brought about. Here, sensor means (36*a*, 36*b*)
(Continued)

are provided which detect a temperature of the pump motor (24) and/or of the hydraulic pump (22), and the predetermined progression over time of the performance characteristic of the hydraulic pump (22) during the rotary/push movement is adapted according to a predetermined relationship depending on the temperature of the pump motor (24) and/or of the pump (22) detected by the sensor means (36*a*, 36*b*).

13 Claims, 3 Drawing Sheets

(51) Int. Cl.
*B66F 9/14* (2006.01)
*F15B 11/00* (2006.01)
*F15B 11/16* (2006.01)

(52) U.S. Cl.
CPC ... *F15B 11/161* (2013.01); *F15B 2211/50509* (2013.01)

(56) References Cited

U.S. PATENT DOCUMENTS

| | | | | |
|---|---|---|---|---|
| 2006/0104783 | A1 | 5/2006 | Schroder | |
| 2010/0050621 | A1* | 3/2010 | Beschorner ..... | E02F 9/2235 60/329 |

FOREIGN PATENT DOCUMENTS

| | | | |
|---|---|---|---|
| DE | 3048471 | A1 | 7/1982 |
| DE | 29802498 | U1 | 4/1998 |
| DE | 102004042336 | A1 | 3/2006 |
| DE | 102007062491 | A1 | 6/2009 |
| JP | 2000289977 | A | 10/2000 |
| JP | 2013221527 | A | 10/2013 |
| KR | 20100023398 | A | 3/2010 |

OTHER PUBLICATIONS

Search Report issued in German Patent Application No. DE102014216736.1, 9 pages (dated Aug. 11, 2015).

* cited by examiner

METHOD FOR CONTROLLING A COMBINED ROTARY/PUSH MOVEMENT

CROSS REFERENCE TO RELATED APPLICATION

This application claims the benefit of German Patent Application No. 10 2014 216 736.1 filed on Aug. 22, 2014, the disclosure of which is incorporated herein in its entirety by reference.

The invention relates to a method and device for controlling a combined rotary/push movement of a load-receiving means of an industrial truck, in particular a three-way stacker, and to an industrial truck comprising said device. Here, according to the invention, the predetermined progression over time of a performance characteristic of a hydraulic pump during the rotary/push movement is adapted according to a predetermined relationship depending on a temperature of the pump motor and/or of the hydraulic pump detected by sensor means.

In particular in modern high-rack warehouses, industrial trucks in the form of three-way stackers are often used. Said stackers are distinguished by the load-receiving means thereof (in particular the forks) being able to carry out a pivoting movement in addition to a lifting movement, so that the forks can be pivoted both in the longitudinal direction of the industrial truck and by up to 90° counter to this direction, and can thus be oriented in the width direction of the industrial truck.

Here, it is of particular practical significance that the load-receiving means pivots by a total of 180°, for example from a position in which the load-receiving means points to the right relative to the longitudinal direction of the industrial truck into a position in which it points to the left. In known three-way stackers, the load-receiving means is attached such that the pivot shaft thereof can be moved in the width direction of the industrial truck, so that the load carried by the load-receiving means extends substantially only in the region of the overall width of the industrial truck during a movement of the industrial truck. This may mean, for example, that when the load-receiving means is pivoted to the left by 90° relative to the longitudinal direction (straight-ahead movement direction) of the industrial truck, the rotary shaft of the load-receiving means is in an end position on the right relative to the width direction of the industrial truck.

If it is provided that the load-receiving means are transferred from a position in which they point to the left into a position in which they point to the right, or vice versa, this can take place in a particularly compact manner such that the pivoting movement of the load-receiving means is overlaid with a push movement of the pivot shaft of the load-receiving means. Such compact pivoting of the load-receiving means makes it possible to also operate the industrial truck where there is limited space, which in practice, for example in a high-rack warehouse, allows reduced rack spacing and thus higher density storage which is more efficient overall.

Here, there is the risk that when the coordinated rotary/push movement of the load-receiving means is not carried out precisely, the load may collide with the high racks. The problem addressed by the present invention is thus to provide a method and a device for controlling a combined rotary/push movement of a load-receiving means of an industrial truck that ensure high precision and reliability of the rotary/push movement and can be implemented with low complexity.

To solve this problem, according to the invention a method for controlling a combined rotary/push movement of a load-receiving means of an industrial truck, in particular a three-way stacker, is proposed, the combined rotary/push movement including a rotary movement of the load-receiving means about a rotary shaft by an angle of 180° and a push movement of the rotary shaft along a pushing path over a predetermined distance, both the rotary movement and the push movement being brought about by means of respective hydraulic elements, which are supplied with hydraulic fluid by a single hydraulic pump which is driven by an associated pump motor, and a performance characteristic of the hydraulic pump being controlled according to a predetermined progression over time during the rotary/push movement, the industrial truck comprising a valve assembly which is designed to be operated such that, below a threshold value for the hydraulic pressure provided by the hydraulic pump, only the rotary movement of the load-receiving means is brought about, while, above the threshold value, both the rotary movement and the push movement are brought about, wherein sensor means are also provided which detect a temperature of the pump motor and/or of the hydraulic pump, and the predetermined progression over time of the performance characteristic of the hydraulic pump during the rotary/push movement is adapted according to a predetermined relationship depending on the temperature of the pump motor and/or of the pump detected by the sensor means.

During operation of conventional industrial trucks in which both the rotary movement and the push movement of the load-receiving means are driven by means of a single hydraulic pump, it has become apparent that temperature changes and in particular overheating of the hydraulic pump may lead to a deviation from the intended ratio of the velocities of the rotary and push movements of the load-receiving means.

This may be understood to be a result of the above-described design of such an industrial truck, in which design the hydraulic pressure provided by the hydraulic pump is split by means of a valve assembly such that the push movement of the load-receiving means only takes place in addition to the rotary movement of the load-receiving means above a predetermined threshold for the hydraulic pressure. In particular, in such a design it may occur that the intended push-movement velocity of the load-receiving means is not reached during the combined rotary/push movement owing to the slippage which increases with the temperature of the pump, while the rotary movement is carried out at the intended velocity, and an undesired operating state may thus arise. As a result, in an extreme case this may lead to the load colliding with a rack or the like if portions of the load are temporarily outside the intended range of the rotary/push movement.

It has become apparent that the methods used until now for correcting a deviation between the intended ratio for the velocities of the rotary and push movements of the load-receiving means and the actual ratio of the velocities of the rotary and push movements of the load-receiving means, such as continuous heating of the hydraulic oil, providing a more complex hydraulic pump with lower temperature sensitivity or providing hydraulic oil flow dividers which can reduce the effects of temperature, are too energy intensive, too expensive and/or disadvantageous for the efficiency of the hydraulic assembly.

A position-controlled adaptation of the performance characteristic of the hydraulic pump, however, leads to a very rough rotary/push movement owing to long idle times and an increased tendency of the load-receiving means to vibrate, and in particular this in turn complicates the precise control of the performance characteristic per se which is required.

It is to the inventor's benefit to have realised that the above-mentioned deviation of the actual rotary/push movement from the intended rotary/push movement can be associated in a simple manner with the temperature of the pump motor and/or of the hydraulic pump, and on the basis of this temperature a performance characteristic of the hydraulic pump can be adapted during the rotary/push movement in order to correct the ratio of the velocities of the rotary and push movements.

Here, it may be advantageously provided that the rotary movement of the load-receiving means takes place at a constant velocity above said threshold value of the hydraulic pressure provided by the hydraulic pump and thus a further increase in the hydraulic pressure only has an effect on the velocity of the push movement of the load-receiving means. This allows the progression over time of the performance characteristic of the hydraulic pump to be adapted particularly easily, since, in particular above the threshold value, the velocity of the rotary movement is not influenced by a change in the hydraulic pressure, but the velocity of the push movement can be finely adjusted hereby.

In particular, the performance characteristic of the hydraulic pump may be a speed of the hydraulic pump.

In a particularly simple and clear embodiment, the predetermined relationship between the progression over time of the performance characteristic of the hydraulic pump and the temperature of the pump motor and/or of the hydraulic pump detected by the sensor means may be a linear relationship, that is to say that, for example, when an increase in the temperature of the pump motor by 10° C. is detected, the speed of the pump is increased by a set percentage. However, a more complicated relationship may also easily be used, which for example parameterises in polynomial form or is used in a control device by means of a predetermined characteristic curve.

In a preferred embodiment, the performance characteristic of the hydraulic pump is controlled such that the rotary/push movement includes the following steps:

- solely rotating the load-receiving means until a load which is carried by the load-receiving means reaches a first maximum extent in projection onto the pushing path,
- simultaneously rotating the load-receiving means and moving the rotary shaft until the load reaches a second maximum extent in projection onto the pushing path,
- solely rotating the load-receiving means until the total rotary angle covered is 180°.

Controlling the rotary/push movement in this way makes it possible to pivot the load in a particularly compact manner and can in particular be used advantageously wherever work is carried out with loads having a predetermined geometry, for example with standardised pallets or containers.

Furthermore, the invention relates to a device for controlling such a combined rotary/push movement of a load-receiving means of an industrial truck, in particular a three-way stacker, the industrial truck comprising: a load-receiving means, which is designed such that it is rotatable about a rotary shaft, the rotary shaft being movable along a pushing path, a first hydraulic element, which is designed to be able to bring about the push movement of the rotary shaft, a second hydraulic element, which is designed to be able to bring about the rotary movement of the load-receiving means, a hydraulic pump, which is driven by an associated pump motor and is designed to provide hydraulic pressure during operation and to supply the first and the second hydraulic element with hydraulic fluid, a control device, which is designed to control a performance characteristic of the hydraulic pump according to a predetermined progression over time during the rotary/push movement, a valve assembly which is designed to supply only the second hydraulic element with hydraulic fluid below a threshold value for the hydraulic pressure provided by the hydraulic pump, whereby the rotary movement of the load-receiving means is brought about at a velocity which is dependent on the performance characteristic, and to supply both the first and the second hydraulic element with hydraulic fluid above the threshold value, whereby both the rotary movement and the push movement are brought about, sensor means, which detect a temperature of the pump motor and/or of the hydraulic pump. Here, the control device is designed to adapt the predetermined progression over time of the performance characteristic of the hydraulic pump during the rotary/push movement according to a predetermined relationship depending on the temperature detected by the sensor means.

The invention further relates to an industrial truck, in particular a three-way stacker, which comprises the above-mentioned device.

Advantages and details of the present invention are explained in greater detail by way of example by means of the embodiment shown in the following schematic drawings, in which.

Figure 1:
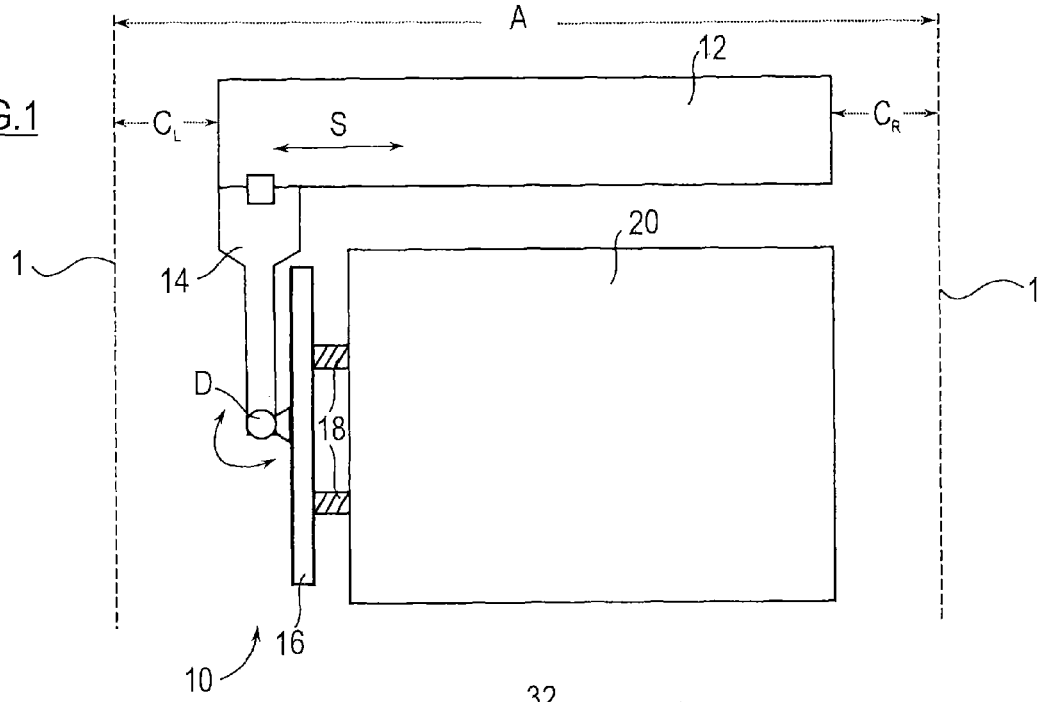
FIG. 1 is a plan view of a load-receiving means of a three-way stacker.
Figure 4:
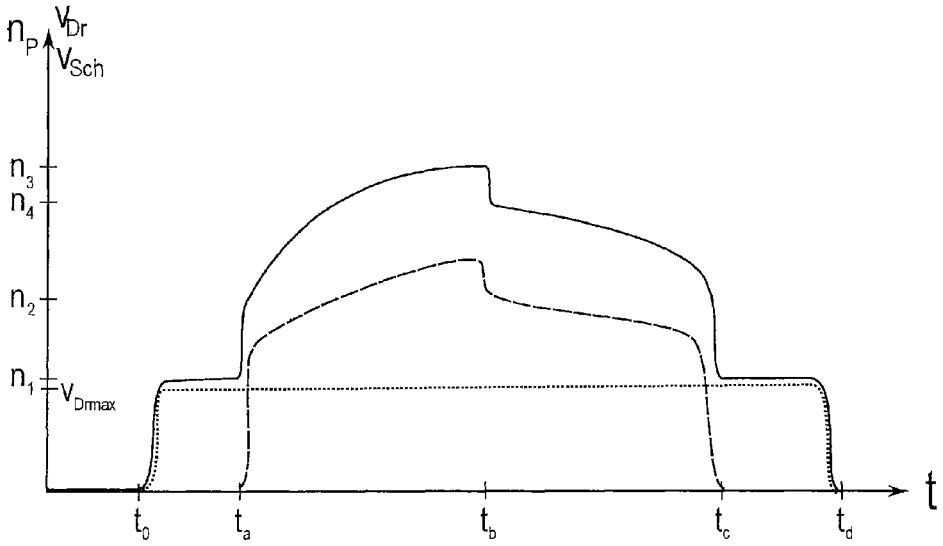
Figure 5A:
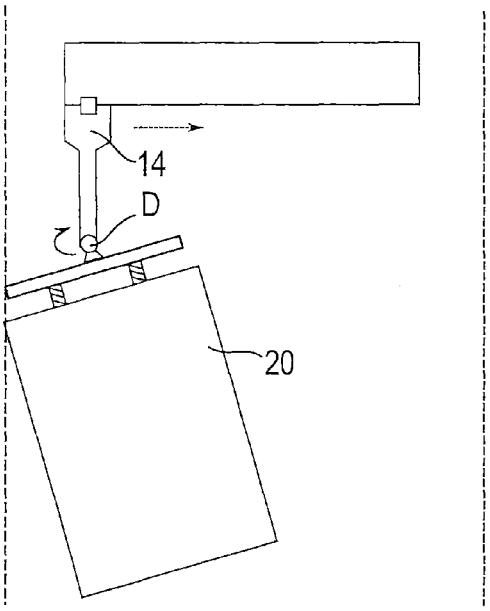
Figure 5B:
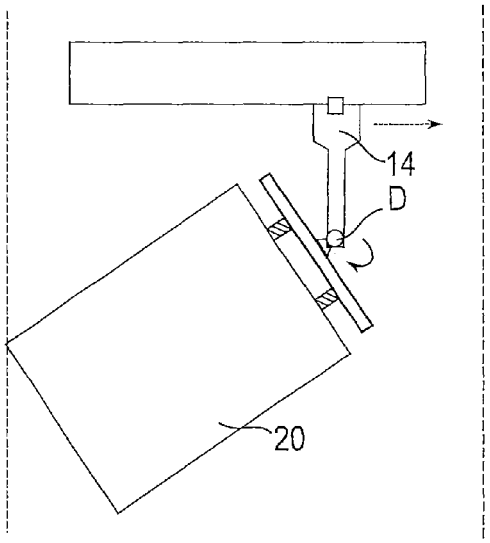

FIGS. 3*a* to 3*d* are schematic views of a combined rotary/push movement of the load-receiving means from FIG. 1;

FIG. 4 shows a schematic relationship between pump speed and rotary and push velocities of the load-receiving means over time;

FIGS. 5*a* and 5*b* show possible misalignments of the load-receiving means from FIG. 1 during a rotary/push movement which has been carried out incorrectly.

In FIG. 1, a load-receiving device of a three-way stacker (not shown) which is known per se is shown in plan view and is generally provided with reference numeral 10. The industrial truck is located in an aisle having the width A, which is formed by high racks 1 which are indicated, and can for example be guided along a predetermined track, in particular on rails. The load-receiving device comprises a push frame 12 on which a cantilever arm 14 is supported so as to be movable in the direction S. Here, the direction S corresponds to the width direction of the three-way stacker. A fork-carrier back 16 is in turn attached to the cantilever arm 14 such that it can pivot about a rotary shaft D relative to the cantilever arm 14 and the push frame 12. Forks 18 are carried by the fork-carrier back in a known manner. In FIG. 1, a load 20 is positioned on the forks 18.

The push frame 12 of the industrial truck is substantially the part of the industrial truck that is widest relative to the width of the aisle A, the left-hand and right-hand spacing between the push frame and the racks 1 indicated by the dashed lines being denoted by $C_L$ and $C_R$ respectively. In the position shown in FIG. 1, the load 20 can for example be removed directly from the right-hand high rack or can be arranged to be inserted into the right-hand high rack and stowed therein.

Figure 3A:
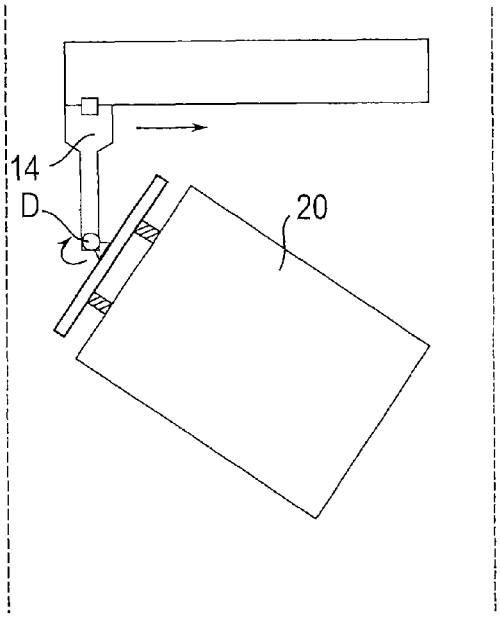

FIGS. 3*a* to 3*d* schematically show the combined rotary/push movement of the load-receiving means 10 of the three-way stacker. Here, FIG. 3*a* shows a state in which only a rotation of the load-receiving means 10 and thus the load 20 has taken place into a position in which the diagonal of the load 20 is exactly perpendicular to the two racks 1. In the embodiment shown, at this rotary angle of the load 20, the push movement of the load-receiving means 10 begins, the rotary movement being continued at the same time.

Figure 3B:
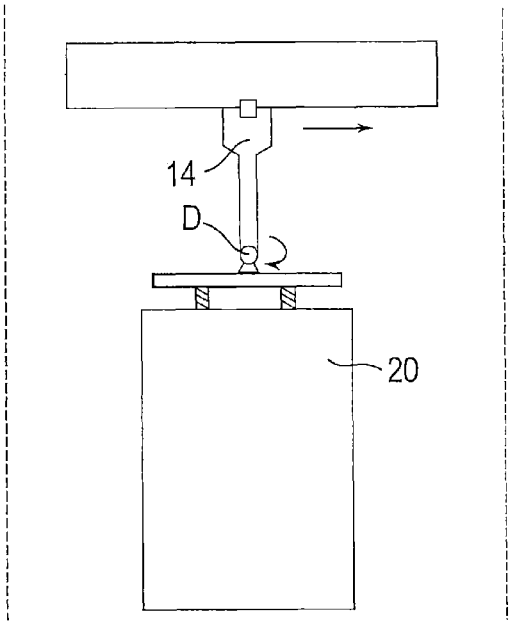
Figure 3C:
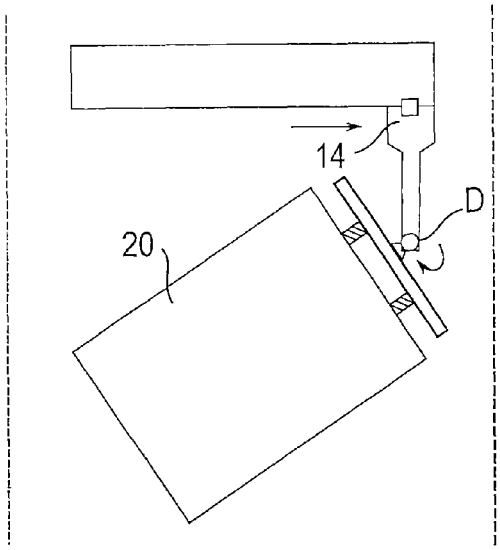

FIG. 3*b* accordingly shows an intermediate position in which the load 20 has already been rotated by 90° relative to the starting position thereof, while in addition the cantilever arm 14 has covered half of the intended pushing path. Both the rotary movement and the push movement continue until the state shown in FIG. 3*c* is reached, in which the cantilever arm 14 has been pushed into the right-hand end position thereof, while in turn the diagonal of the load 20 is perpendicular to the two high racks 1. In this position, the forward movement of the cantilever arm 14 stops, while the rotary movement initially continues.

Figure 3D:
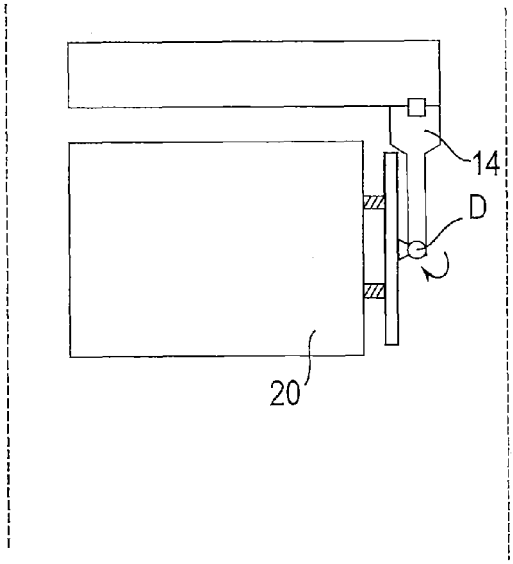

Lastly, the end state shown in FIG. 3*d* is reached, in which the cantilever arm 14 is still in the right-hand end position thereof, while the rotation by a total of 180° of the load 20 has been completed. As can be seen in FIGS. 3*a* to 3*d*, by overlaying the rotary and push movements, the load pivots by 180° while requiring a minimum amount of space.

Figure 2:
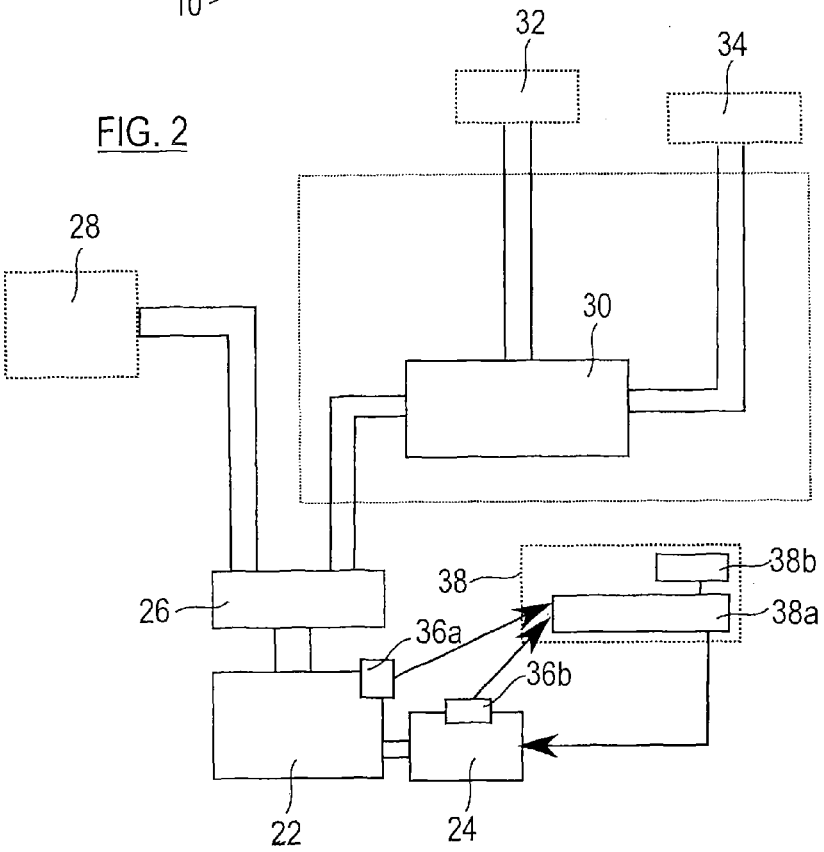
FIG. 2 is a schematic view of a control- and hydraulics system according to the invention.

FIG. 2 highly schematically shows the hydraulics- and control system, which enables the above-discussed combined rotary/push movement of the load-receiving means 10. Here, a single hydraulic pump 22 is provided, which is driven by a hydraulic-pump motor 24 in a known manner, for example by a transmission (not shown). Here, the speed of the pump motor 24 and the speed of the hydraulic pump 22 are directly associated. The hydraulic oil conveyed by the hydraulic pump 22 is firstly provided, by a first valve assembly 26 in a controllable manner, both to a main lift device 28 of the load-receiving means and to a second valve assembly 30. This second valve assembly 30 provides the hydraulic oil to a first hydraulic element 32 and a second hydraulic element 34 in a manner which will be described later in conjunction with FIG. 4. Here, the first hydraulic element 32 is designed to bring about the push movement of the cantilever arm 14, while the second hydraulic element 34 is designed to bring about the rotary movement of the load-receiving means 10. The hydraulic pump 22 and the pump motor 24 are each assigned temperature sensors 36*a* and 36*b*, which measure the temperature of the hydraulic pump 22 and of the pump motor 24 respectively. The measured temperatures are transferred to the control device 38, which controls the operation of the pump motor 24.

For this purpose, the control device 38 is provided with a processor unit 38*a* and a storage unit 38*b*, the processing unit 38*a* generating a predetermined time-dependent control signal, which corresponds to a predetermined control progression over time, on the basis of data for the pump motor 24 which are provided by the storage unit 38*b*. When the control device 38 receives an instruction from a user of the industrial truck to rotate the load-receiving means 10, said device controls the hydraulic motor 24 according to the above-mentioned progression over time.

The predetermined progression over time of the speed of the pump motor, which progression is controlled by the control device 38, is shown schematically in FIG. 4 by the solid line. Here, at an instant $t_0$ which corresponds to the state shown in FIG. 1, the pump motor 24 is started up at a first speed $n_1$, at the instant $t_a$ which corresponds to the state shown in FIG. 3*a*, the speed of the pump motor 24 is increased to a second speed value $n_2$, until a time $t_b$, the speed of the motor is further increased to a value $n_3$ according to a predetermined control characteristic curve and at the instant $t_b$ is reduced again to the speed value $n_4$. Here, the time $t_b$ corresponds to the state shown in FIG. 3*b*. Then, the speed of the pump motor 24 is again further reduced according to a predetermined characteristic curve until the instant $t_c$, said instant corresponding to the state shown in FIG. 3*c*. Between the time $t_c$ and the time $t_d$, the pump motor 24 is finally again operated at the speed $n_1$ until the state shown in FIG. 3*d* is reached at the instant $t_d$, whereupon the combined rotary/push movement of the load-receiving means 10 is completed.

In order to achieve the desired combined rotary/push movement of the load-receiving means 10, the second valve assembly 30 is designed to divide the hydraulic oil such that the velocity $v_{Dr}$ of the rotary movement of the load-receiving means 10 corresponds to the dotted line shown in FIG. 4, while the velocity $v_{Sch}$ of the push movement of the load-receiving means 10 corresponds to the dashed line. This is achieved by only the second hydraulic element 34 being supplied at a rotational speed of the pump which corresponds to a motor speed of a value of at most $n_1$, and thus only a rotary movement of the load-receiving means 10 being brought about. If the motor speed is increased beyond the value $n_1$, as shown in FIG. 4 between the times $t_a$ and $t_c$, then the hydraulic pressure generated by the hydraulic pump 22 increases, the rotary movement of the load-receiving means 10, as shown in FIG. 4 by the dotted line, still proceeding at a constant velocity $v_{Drmax}$, however. The hydraulic pressure which is additionally provided thus merely leads to the push movement of the load-receiving means 10 starting, which accelerates further when the motor speed increases further. As shown in FIG. 4, the push velocity $v_{Sch}$ reaches its maximum at the instant $t_b$ and is then reduced again. By the hydraulic-pump motor 24 cooperating with the second valve assembly 30, the combined rotary movement of the load-receiving means 10 as shown in FIGS. 1 and 3*a* to 3*d* can thus be carried out.

If, however, during the combined rotary/push movement of the load-receiving means 10, the intended hydraulic pressure is not reached for example owing to increased slippage in the hydraulic pump 22 as a result of heating in the hydraulic pump 22 and/or of the conveyed hydraulic oil, then the problems which are shown schematically in FIGS. 5*a* and 5*b* may occur.

FIG. 5*a* shows a state in which although the rotary movement of the load-receiving means 10 is initiated, the push movement which is also intended is not. This may be the case if the pressure applied to the second valve assembly 30 does not reach the threshold value above which the push movement is initiated, and thus all the hydraulic pressure is used only for rotating the load-receiving means 10. As shown in FIG. 5*a*, the load 20 may thus collide with the high racks 1.

Lastly, FIG. 5*b* shows a case in which although the push movement of the load-receiving means 10 has been initiated, it has been carried out too slowly. This case may occur if the hydraulic pressure which is falling at the second valve assembly 30 is above the threshold value, but nevertheless, between the times $t_a$ and $t_c$, is less than the value which is actually intended. In the case shown in FIG. 5*b*, the push movement thus ends before the end point which is actually intended, while the rotary movement proceeds as intended, and again the load 20 may thus collide with the rack 1.

In order to prevent the cases shown in FIGS. 5*a* and 5*b*, the control device 38 is designed according to the invention to adapt or adjust the speed of the pump motor 24 during operation according to a predetermined relationship as a response to the temperature data from the sensors 36*a* and 36*b*. Here, the speed value $n_3$ can for example be increased by a determined percentage per 10° heating of the pump motor 24, and this also in turn has an effect on the speed increase between the times $t_a$ and $t_b$. This measure compensates for the increasing slippage of the hydraulic system and ensures that the combined rotary/push movement of the load-receiving means 10 is carried out as intended. Here, it should be noted that different hydraulic-pump/valve-assembly systems of course have different temperature characteristics, and therefore a suitable temperature-adaptation characteristic of the system must be determined in advance depending on the installation, which characteristic is stored in the storage unit 38*b* and used by the processor unit 38*a* of the control unit 38 to control the pump motor 24.

The invention claimed is:

1. A method for controlling a combined rotary/push movement of a load-receiving means (10) of an industrial truck, the method comprising:

providing a rotary movement of the load-receiving means (10) about a rotary shaft (D) by an angle of 180° and a push movement of the rotary shaft (D) along a pushing path (S) over a predetermined distance;

wherein both the rotary movement and the push movement are brought about by respective hydraulic elements (32, 34), which are supplied with hydraulic fluid by a single hydraulic pump (22) which is driven by an associated pump motor (24), controlling a performance characteristic of the hydraulic pump (22) according to a predetermined progression over time during the rotary/push movement;

wherein the industrial truck comprises a valve assembly (30) configured to provide:

only the rotary movement of the load-receiving means (10) when a hydraulic pressure provided by the hydraulic pump (22) is below a threshold value, and both the rotary movement and the push movement when the hydraulic pressure provided by the hydraulic pump (22) is above the threshold value, providing sensor means (36*a*, 36*b*) to detect a temperature of the pump motor (24) and/or of the hydraulic pump (22), and adapting the predetermined progression over time of the performance characteristic of the hydraulic pump (22) during the rotary/push movement according to a predetermined relationship depending on the temperature of the pump motor (24) and/or the pump (22) detected by the sensor means (36*a*, 36*b*); wherein the performance characteristic is controlled such that the rotary/push movement includes the following steps: a) solely rotating the load-receiving means (10) until a load (20) which is carried by the load-receiving means reaches a first maximum extent in projection onto the pushing path (S); b) simultaneously rotating the load-receiving means (10) and moving the rotary shaft (D) until the load (20) reaches a second maximum extent in projection onto the pushing path (S); c) solely rotating the load-receiving means until the total rotary angle covered is 180°.

2. The method of claim 1, wherein, above the threshold value, the rotary movement takes place at a substantially constant rotational velocity ($v_{Drmax}$) which corresponds to the threshold value.

3. The method of claim 1, wherein the performance characteristic is a speed of the hydraulic pump (22).

4. The method of claim 1, wherein the predetermined relationship is a linear relationship.

5. A device for controlling a combined rotary/push movement of a load-receiving means (10) of an industrial truck, the device comprising:

a load-receiving means (10) attached to a rotary shaft (D) and configured to rotate about the rotary shaft (D), wherein the rotary shaft (D) is configured to move along a pushing path (S);

a first hydraulic element (32) configured to provide a push movement of the rotary shaft (D);

a second hydraulic element (34) configured to provide a rotary movement of the load-receiving means (10);

a hydraulic pump (22) driven by an associated pump motor (24) and configured to provide hydraulic pressure during operation and to supply the first and the second hydraulic element (32, 34) with hydraulic fluid;

a control device (38) configured to control a performance characteristic of the hydraulic pump (22) according to a predetermined progression over time during the rotary/push movement;

a valve assembly (30) configured:

to supply only the second hydraulic element (34) with hydraulic fluid when the performance characteristic of the hydraulic pump (22) is below a threshold value, whereby the rotary movement of the load-receiving means (10) is brought about at a rotational velocity ($v_{Dr}$) which is dependent on the performance characteristic, and to supply both the first hydraulic element (32) and the second hydraulic element (34) with hydraulic fluid when the performance characteristic of the hydraulic pump (22) is above the threshold value, thereby providing both the rotary movement and the push movement;

sensor means (36*a*, 36*b*) configured to detect a temperature of the pump motor (24) and/or of the hydraulic pump (22), wherein the control device (38) is configured to adapt the predetermined progression over time of the performance characteristic of the hydraulic pump (22) during the rotary/push movement according to a predetermined relationship depending on the temperature detected by the sensor means (36*a*, 36*b*); wherein the performance characteristic is controlled such that the rotary/push movement includes the following steps: a) solely rotating the load-receiving means (10) until a load (20) which is carried by the load-receiving means reaches a first maximum extent in projection onto the pushing path (S); b) simultaneously rotating the load-receiving means (10) and moving the rotary shaft (D) until the load (20) reaches a second maximum extent in projection onto the pushing path (S); c) solely rotating the load-receiving means until the total rotary angle covered is 180°.

6. The device of claim 5, wherein, above the threshold value, the rotary movement takes place at a substantially constant rotational velocity ($v_{Drmax}$) which corresponds to the threshold value.

7. The device of claim 5, wherein the performance characteristic is a speed of the hydraulic pump (22).

8. The device of claim 5, wherein the predetermined relationship is a linear relationship.

9. Industrial truck comprising the device according to claim 5.

10. A method for controlling a combined rotary/push movement of a load-receiving means of an industrial truck, the method comprising:

providing a rotary movement of the load-receiving means about a rotary shaft by an angle of 180° and a push movement of the rotary shaft along a pushing path over a predetermined distance, wherein both the rotary movement and the push movement are brought about by respective hydraulic elements, which are supplied with hydraulic fluid by a single hydraulic pump which is driven by an associated pump motor, controlling a performance characteristic of the hydraulic pump according to a predetermined progression over time during the rotary/push movement;

wherein the industrial truck comprises a valve assembly configured to provide:

only the rotary movement of the load-receiving means when a hydraulic pressure provided by the hydraulic pump is below a threshold value, and both the rotary movement and the push movement when the hydraulic pressure provided by the hydraulic pump is above the threshold value, providing sensor means to detect a temperature of the pump motor and/or of the hydraulic pump, and adapting the predetermined progression over time of the performance characteristic of the hydraulic pump during the rotary/push movement according to a predetermined relationship depending on the temperature of the pump motor and/or the pump detected by the sensor means, wherein the performance characteristic is controlled such that the rotary/push movement includes the following steps:

a) solely rotating the load-receiving means until a load which is carried by the load-receiving means reaches a first maximum extent in projection onto the pushing path;

b) simultaneously rotating the load-receiving means and moving the rotary shaft until the load reaches a second maximum extent in projection onto the pushing path; and c) solely rotating the load-receiving means until the total rotary angle covered is 180°.

11. The method of claim 10, wherein, above the threshold value, the rotary movement takes place at a substantially constant rotational velocity ($v_{Drmax}$) which corresponds to the threshold value.

12. The method of claim 10, wherein the performance characteristic is a speed of the hydraulic pump.

13. The method of claim 10, wherein the predetermined relationship is a linear relationship.

* * * * *